US007036890B2

(12) United States Patent
Hill et al.

(10) Patent No.: US 7,036,890 B2
(45) Date of Patent: May 2, 2006

(54) CORE BREAKER FOR AN EARTH STRATA CUTTING ASSEMBLY

(75) Inventors: Tod Duane Hill, Madisonville, KY (US); Kris Edwin Strothmann, Mt. Vernon, IL (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 10/749,331

(22) Filed: Dec. 31, 2003

(65) Prior Publication Data

US 2005/0146198 A1 Jul. 7, 2005

(51) Int. Cl.
*E21C 25/10* (2006.01)

(52) U.S. Cl. ..... 299/85.1; 299/106; 299/79.1

(58) Field of Classification Search ..... 299/79.1, 299/85.1, 85.2, 102, 106, 107, 110, 113, 95
See application file for complete search history.

(56) References Cited

U.S. PATENT DOCUMENTS 3,279,856 A 10/1966 Silks
3,712,679 A 1/1973 Amoroso
3,752,515 A 8/1973 Oaks et al.
4,316,636 A 2/1982 Taylor et al.
4,542,943 A 9/1985 Montgomery, Jr.
4,669,786 A * 6/1987 Morgan et al. ..... 299/76
5,647,641 A * 7/1997 Sulosky et al. ..... 299/106
6,102,485 A * 8/2000 Parrott ..... 299/81.3
6,315,365 B1 * 11/2001 Gerer et al. ..... 299/85.1
6,343,842 B1 * 2/2002 Sauer et al. ..... 299/79.1

OTHER PUBLICATIONS

Kennametal Catalog B00-023(10)J0—entitled "Cutting and Drilling Systems" (2000) (84 pages).

* cited by examiner

*Primary Examiner*—John Kreck
(74) *Attorney, Agent, or Firm*—Matthew W. Smith

(57) ABSTRACT

A core breaker that includes a support that contains at least one bore wherein the bore is defined in part by an axial forward frusto-conical wall and further defined by an axial rearward cylindrical wall that contains a groove therein. The core breaker has an elongate rotatable cutting tool that has an axial forward end and an axial rearward end, as well as a head adjacent to the axial forward end and a shank adjacent to the axial rearward end wherein the shank contains a reduced diameter portion. There is a frusto-conical shoulder mediate of the head and the shank. The cutting tool further includes a resilient retainer that has at least one radial outward protrusion. When the cutting tool is retained within the bore, the protrusions of the resilient retainer are received within the groove in the bore and the frusto-conical shoulder of the cutting tool is closely adjacent to the frusto-conical wall of the bore.

35 Claims, 6 Drawing Sheets

CORE BREAKER FOR AN EARTH STRATA CUTTING ASSEMBLY

BACKGROUND OF THE INVENTION

The invention pertains to a core breaker for use with an earth strata cutting assembly such as, for example, a continuous mining machine. More specifically, the invention pertains to a core breaker for use with such an earth strata cutting assembly wherein the core breaker contains easily replaceable rotatable cutting tools.

As mentioned above, one example of an earth strata cutting assembly is a continuous mining machine. A typical continuous mining machine typically includes a plurality of rotatable cutting drums that are advanced so as to engage the earth strata (e.g., coal in a vein) and cut or rip the same into fragments. U.S. Pat. No. 3,712,679 to Amoroso shows a continuous mining machine. The earth strata (e.g., coal) that is cut or ripped from the vein falls onto the floor of the mine, and is then handled in a suitable fashion so that it is removed from the vicinity of the continuous mining machine. In a typical continuous mining machine, the cutting drums are spaced apart so that they do not cut across the entire face of the vein. Thus, after completion of the cutting by the cutting drums, there remains a volume of earth strata (or coal) that needs to be removed in order for the continuous mining machine to continue to advance in the cutting operation. In order to remove the remaining earth strata, a core breaker is positioned between each one of the adjacent cutting drums whereby the core breaker includes a plurality of bits that impinge upon the remaining volume of coal so as to break it into fragments.

In a commercial underground mining environment, the core breaker associated with a typical continuous mining machine has a plurality of cutting members secured (such as by welding) to the support of the core breaker. When a cutting member becomes worn (or otherwise is in a non-useful condition), it is not unusual that the core breaker must be removed from the mining machine and then the cutting member is removed such as by cutting with a welding torch. A new cutting member is then welded to the core breaker support and the core breaker is placed back in the mining machine. There also may be situations where the worn cutting member can be cut by a welding torch without removing the core breaker from the mining machine. As can be appreciated, it is not an easy task to remove the core breaker from the mining machine and then install the core breaker in the mining machine. For either situation, it is not an easy task to remove the worn (or non-useful) cutting member by cutting with a welding torch and then re-welding a new cutting member to the core breaker support.

U.S. Pat. No. 4,669,786 to Morgan et al. discloses a core breaker that has replaceable bits (17) held in a support (13). The bit (17) shown in the Morgan et al. patent has an axial forward end that is flat (or blunt). The bit has a blunt axial forward end. A frusto-conical portion extends rearwardly from the blunt axial forward end. A cylindrical portion extends rearwardly from the frusto-conical portion. The cylindrical portion terminates at the axial rearward end of the bit. The bits of the Morgan et al. patent appear to be made out of only one material.

The fact that the tip is blunt would appear to increase the energy (or power) necessary to drive the core breaker of the Morgan et al. patent through the earth strata. In addition to requiring more energy to drive the bit, a bit that has a blunt tip increases the resistance, and hence, increases the forces exerted on the bit. Such an increase in the forces exerted on the bit increases the chance that the bit will fail through breakage. In light of the geometry of the bit and the manner it is held in the support as disclosed in the Morgan et al. patent, it would appear likely that any breakage could be expected to occur at the point where the cylindrical section protrudes out of the support (13). If a bit broke off at this location, it would appear to be very difficult, if not impossible, to remove such a bit from the support.

Even if the bit did not fail by breakage, but merely wore out, it still appears that it would be difficult to replace the bit of the Morgan et al. patent. In this regard, the bit shown in the Morgan et al. patent is retained by the use of a core breaker support that contains what appears to be two bores of different diameters wherein there is a shoulder at the joinder of these bores. A snap ring carried in a groove in the bit abuts against the shoulder. There does not appear to be any way to easily disengage the snap ring, and thus, one would have to pull the bit out of the support against the resistance provided by the abutment between the shoulder and the snap ring whereby the force exerted on the bit would have to be enough to deform the snap ring.

The bit in the Morgan et al. patent appears to be non-rotatable. In operation, the Morgan et al. bits generally flex in one direction opposite the direction of travel of the mining machine. This is especially true of the core breaker bits having a vertical (or a vertical component in its) orientation. The flexure causes the forward side of the bit to experience tension forces and on the rearward side of the bit experiences compressive forces. The continual application of tension and compressive forces on the bit may ultimately result in an early failure of the bit by fatigue.

It further appears that the core breaker support (13) as disclosed in the Morgan et al. patent does not provide for any structural support for the most rearward part of the cylindrical portion of the bit during the operation of the continuous mining machine.

It would thus be desirable to provide an improved core breaker for use in an earth strata cutting assembly (e.g., a continuous mining machine) wherein the core breaker uses a cutting tool that has a hard carbide tip brazed to the cutting tool at the axial forward end thereof.

It would thus be desirable to provide an improved core breaker for use in an earth strata cutting assembly (e.g., a continuous mining machine) wherein the core breaker uses a cutting tool that has a relatively sharp hard carbide tip at the axial forward end thereof so as to not increase the energy necessary to drive the core breaker through the earth strata.

It would thus be desirable to provide an improved core breaker for use in an earth strata cutting assembly (e.g., a continuous mining machine) wherein the core breaker uses a cutting tool that has a relatively sharp hard carbide tip at the axial forward end thereof so as to not increase the resistance to the passage of the cutting tool through the earth strata which therefore does not increase the forces exerted on the cutting tool.

It would thus be desirable to provide an improved core breaker for use in an earth strata cutting assembly (e.g., a continuous mining machine) wherein the core breaker uses a cutting tool that is relatively easy to extract even after failure.

It would thus be desirable to provide an improved core breaker for use in an earth strata cutting assembly (e.g., a continuous mining machine) wherein the core breaker provides easily replaceable cutting tools after the tool has become worn to a point where it does not cut in a satisfactory manner.

It would thus be desirable to provide an improved core breaker for use in an earth strata cutting assembly (e.g., a continuous mining machine) wherein the core breaker uses a cutting tool that is rotatable about its central longitudinal axis so that tension and compressive forces are distributed forces about the circumference of the cutting tool body improving the fatigue life of the cutting tool and preventing the concentration of forces (either tension forces or compressive forces) at one side.

It would also be desirable to provide an improved core breaker for use in an earth strata cutting assembly (e.g., a continuous mining machine) wherein the core breaker provides structural support for the rearward portion of the cutting tool during the operation of the continuous mining machine.

It would thus be desirable to provide an improved core breaker for use in an earth strata cutting assembly (e.g., a continuous mining machine) wherein the core breaker provides support for the cutting tool so as to prevent it from being driven into the bore.

SUMMARY OF THE INVENTION

In one form thereof the invention is a core breaker that comprises a support that contains at least one bore wherein the bore is defined in part by an axial forward frusto-conical wall and an axial rearward cylindrical wall. The axial rearward cylindrical wall contains a groove therein. There is an elongate rotatable cutting tool that has an axial forward end and an axial rearward end. The cutting tool has a head adjacent to the axial forward end and a shank adjacent to the axial rearward end, and a frusto-conical shoulder mediate of the head and the shank. The shank contains a reduced diameter portion. The cutting tool further includes a resilient retainer. When the cutting tool is retained within the bore, the resilient retainer is received within the groove in the bore and the frusto-conical shoulder of the cutting tool is closely adjacent to the frusto-conical wall of the bore.

In another form thereof, the invention is a core breaker support for use in conjunction with at least one elongate cutting tool wherein the cutting tool has an axial forward end and an axial rearward end and a head adjacent to the axial forward end and a shank adjacent to the axial rearward end. The cutting tool further has a frusto-conical shoulder mediate of the head and the shank wherein the shank contains a reduced diameter portion and the cutting tool further has a resilient retainer. The core breaker comprises a support that contains at least one bore. The bore is defined in part by an axial forward frusto-conical wall and further defined by an axial rearward cylindrical wall. The axial rearward cylindrical wall contains a groove therein. When the cutting tool is retained within the bore, the resilient retainer is received within the groove in the bore and the frusto-conical shoulder of the cutting tool is closely adjacent to the frusto-conical wall of the bore.

In yet another form thereof, the invention is an earth strata cutting assembly that comprises at least a pair of adjacent cutting drums and a core breaker mediate of the cutting drums. The core breaker comprises a support that contains at least one bore wherein the bore is defined in part by an axial forward frusto-conical wall and is further defined by an axial rearward cylindrical wall wherein the axial rearward cylindrical wall containing a groove therein. The assembly includes an elongate rotatable cutting tool that has an axial forward end and an axial rearward end. The cutting tool has a head adjacent to the axial forward end and a shank adjacent to the axial rearward end. The tool also has a frusto-conical shoulder mediate of the head and the shank. The shank contains a reduced diameter portion. The cutting tool further includes a resilient retainer. When the cutting tool is retained within the bore, the resilient retainer is received within the groove in the bore and the frusto-conical shoulder of the cutting tool is closely adjacent to the frusto-conical wall of the bore.

In yet another form thereof, the invention is a core breaker that includes a support that contains a plurality of rows of bores wherein each one of the bores is defined in part by an axial forward frusto-conical wall and is further defined by an axial rearward cylindrical wall. The axial rearward cylindrical wall contains a groove therein. An elongate rotatable cutting tool is contained within each one of the bores. The rotatable cutting tool has an axial forward end and an axial rearward end, as well as a head adjacent to the axial forward end, a shank adjacent to the axial rearward end, and a frusto-conical shoulder mediate of the head and the shank. The shank contains a reduced diameter portion. The rotatable cutting tool further includes a resilient retainer. When the rotatable cutting tool is retained within the bore, the resilient retainer is received within the groove in the bore and the frusto-conical shoulder of the rotatable cutting tool is closely adjacent to the frusto-conical wall of the bore.

In still another form thereof, the invention is a core breaker that comprises a support that contains at least one bore. The core breaker further includes an elongate rotatable cutting tool that is rotatably contained within the bore.

In yet another form thereof, the invention is an earth strata cutting assembly that includes at least a pair of adjacent cutting drums and a core breaker mediate of the cutting drums. The core breaker comprises a support containing at least one bore. There is an elongate rotatably cutting tool that is rotatably contained within the bore.

In yet another form thereof, the invention is a core breaker that comprises a support that contains at least one bore, and an elongate cutting tool that has a relatively sharp tip.

BRIEF DESCRIPTION OF THE DRAWINGS

The following is a brief description of the drawings that form a part of this patent application.

DETAILED DESCRIPTION OF THE INVENTION

Figure 1:
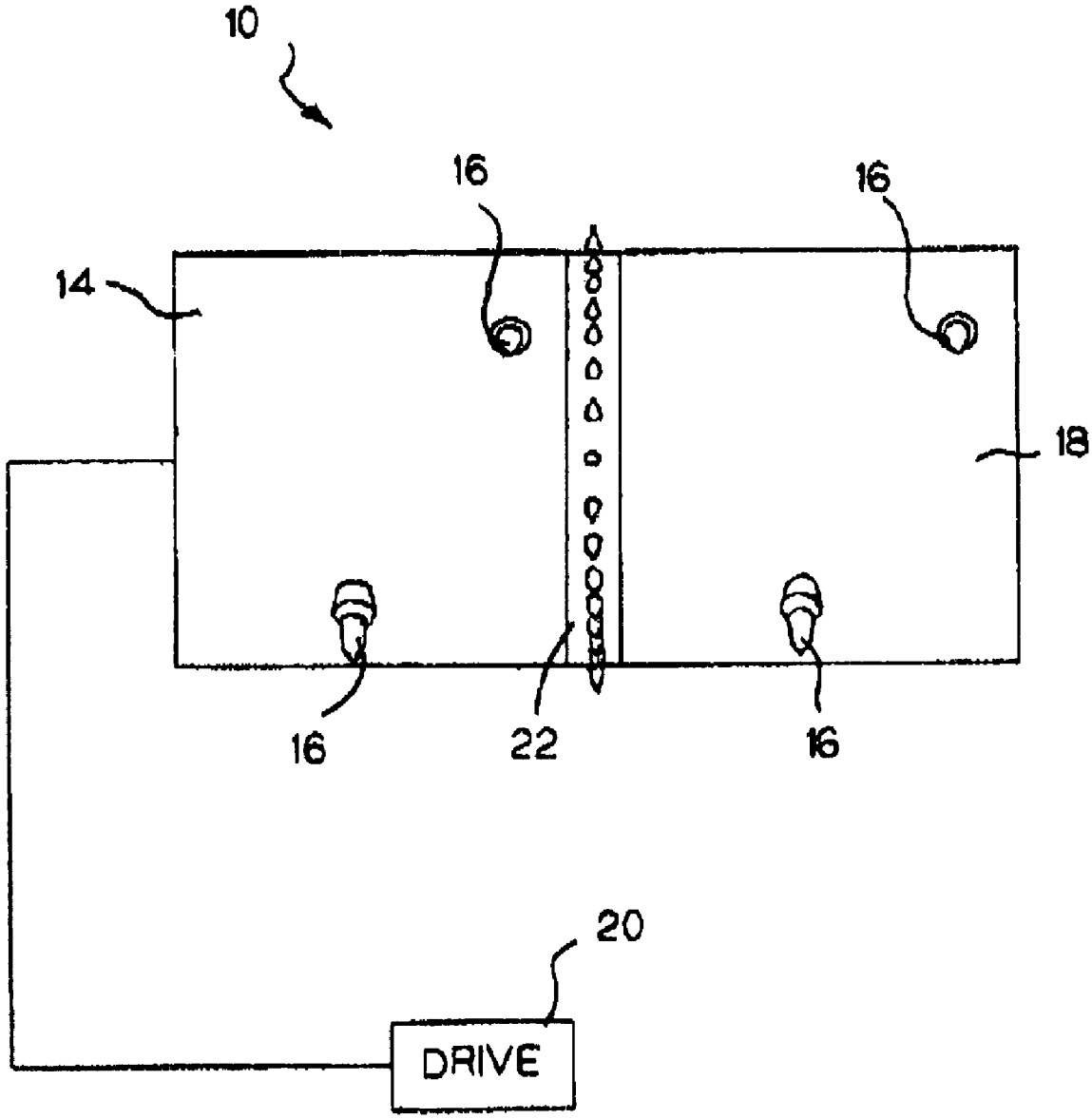
FIG. 1 is a mechanical schematic view of a first embodiment of a continuous mining machine (i.e., an earth strata cutting assembly) that includes two cutting drums and a core breaker that is positioned mediate of the two cutting drums.

Referring to the drawings, FIG. 1 shows a portion of a specific embodiment of a continuous mining machine (i.e., an earth strata cutting assembly) generally designated as 10. Continuous mining machine 10 includes a first rotatable cutting drum 14 that presents a plurality of cutting tools (or bits) 16 arranged in a helical pattern. Continuous mining machine 10 further includes a second rotatable cutting drum 18 that also presents a plurality of cutting tools (or bits) 16 arranged in a helical pattern. The first cutting drum 14 is spaced apart from (and yet can be considered to be adjacent to) the second cutting drum 18. The cutting drums (14, 18) are operatively connected to a motor 20 that drives the rotatable cutting drums (14, 18). A core breaker 22 is positioned so as to be between the first and second cutting drums (14, 18).

Figure 2:
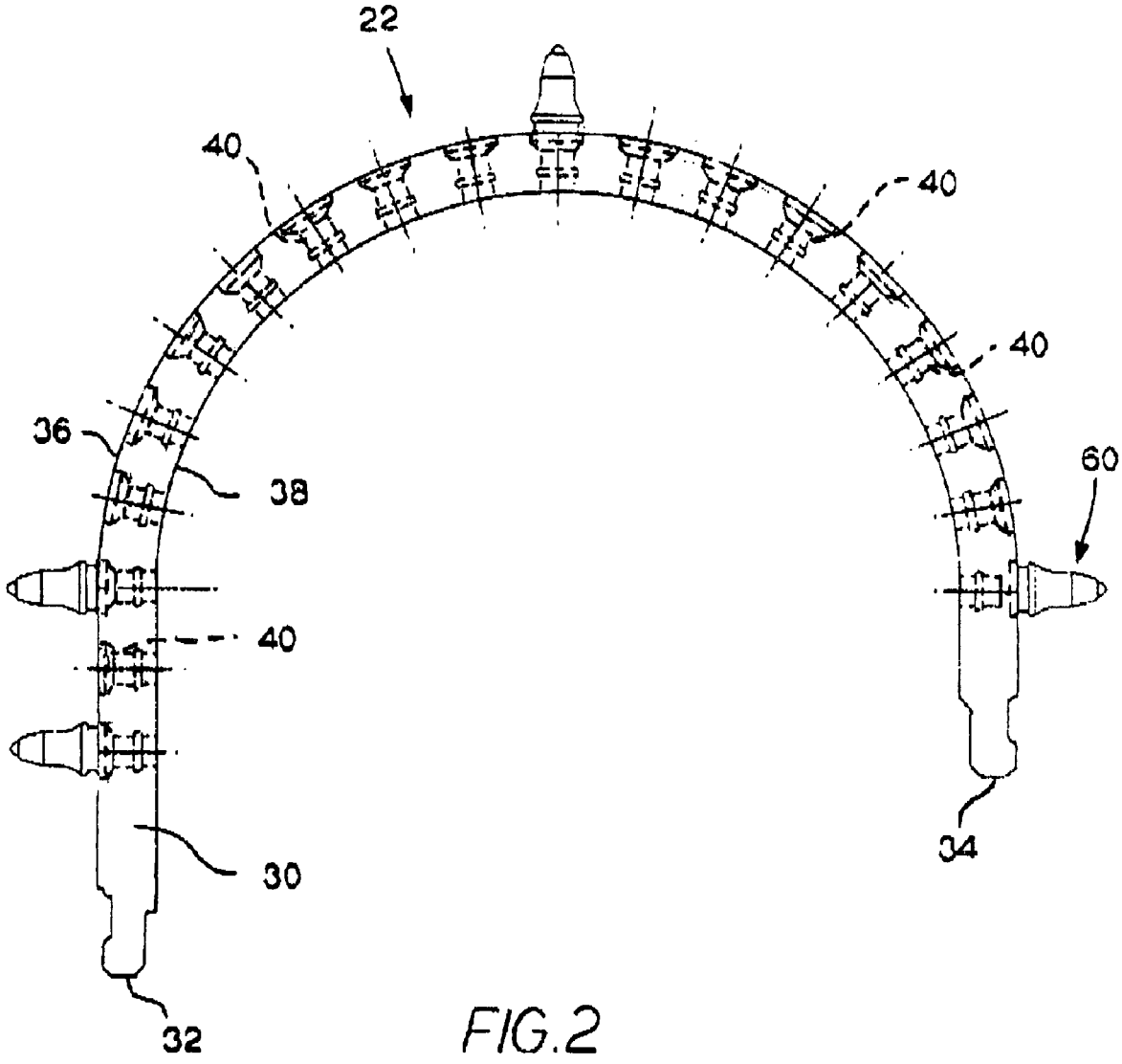
FIG. 2 is a side view of one section of the core breaker support of the core breaker of FIG. 1 wherein the bores are illustrated by dashed lines and a number of rotatable cutting tools are rotatably contained within their corresponding bore.
Figure 3:
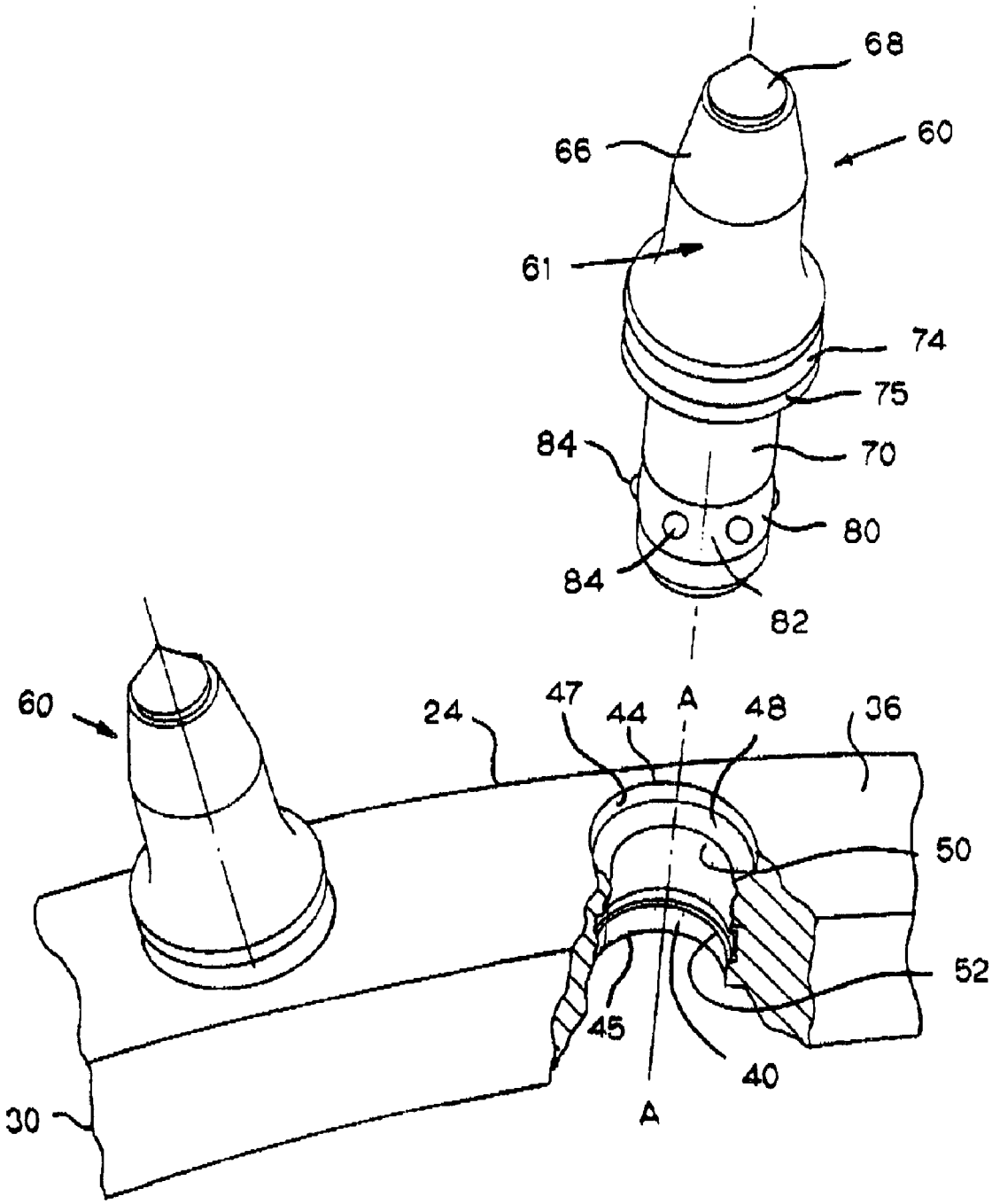
FIG. 3 is an isometric view of two adjacent cutting bits and a portion of the core breaker support of the core breaker of FIG. 1 wherein one of the cutting bits is rotatably contained within its corresponding bore in the core breaker support and the other cutting bit is exploded away from its corresponding bore and a portion of the core breaker support is broken away to show the bore that corresponds to the other exploded-away cutting bit.
Figure 4:
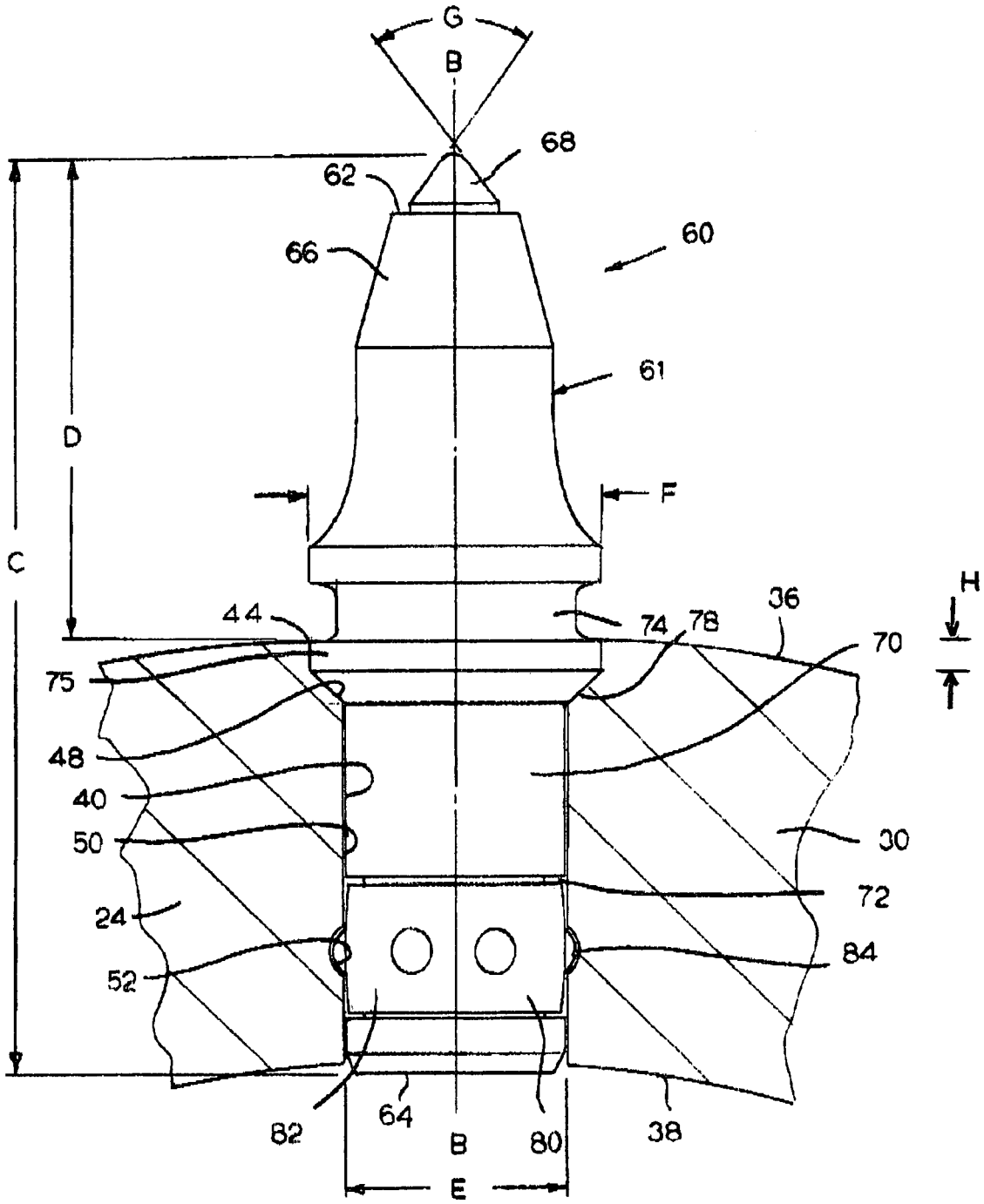
FIG. 4 is a side view of an elongate rotatable cutting bit rotatably contained within its corresponding bore of the core breaker support wherein the core breaker support is shown in cross-section.

Referring to the core breaker 22 and especially to FIGS. 2 through 4, core breaker 22 includes a core breaker support 30. The core breaker support 30 has an elongate shape. The core breaker support 30 has opposite ends 32 and 34. The core breaker support 30 has a radial outward surface 36 and a radial inward surface 38.

The core breaker support 30 contains a plurality of radial-oriented bores 40 along the entire length thereof. Each bore 40 has a longitudinal axis A—A (see FIG. 3) and an axial forward end 44 and an axial rearward end 45. The bore 40 is defined at least in part by an axial forward cylindrical wall 75 at the axial forward end 44 of the bore 40. The bore 40 is further defined in part by an axial forward frusto-conical wall 48 that is contiguous with and axial rearward of the axial forward cylindrical wall 47. The bore 40 is also defined at least in part by an axial rearward cylindrical wall 50 that is contiguous with and extends in an axial rearward direction from the axial forward frusto-conical wall 48. The axial rearward cylindrical wall 50 contains an annular groove 52 therein. Annular groove 52 is located axial forward of the axial rearward end 44 of the bore 40.

The preferred rotatable cutting tool 60 used for this core breaker is a U51KHL 75 conical bit made and sold by Kennametal Inc. of Latrobe, Pa. 15650 (USA) (the assignee of the present patent application). Cutting tool 60 has a central longitudinal axis B—B. Cutting tool 60 has a steel body 61 that has an axial forward end 62 and an axial rearward end 64. Cutting tool 60 has a head 66 adjacent to the axial forward end 62 thereof. Head 66 carries a hard carbide tip 68 at the axial forward end of the cutting tool 60. Although the socket is not shown in the drawings, the tool body 61 contains a socket at the axial forward end thereof wherein the hard carbide tip 68 is brazed into the socket so as to be attached to the tool body 61. Typically, the hard carbide tip 68 is made from cemented (cobalt) tungsten carbide.

Cutting tool 60 further includes a shank 70 adjacent the axial rearward end 64 thereof. The shank 70 has a reduced diameter section 72 spaced axial forward of the axial rearward end 64 thereof. Cutting tool 60 further contains a puller groove 74, a cylindrical collar (or portion) 75 that is axial rearward of the puller groove 74, and a rearward facing frusto-conical shoulder 78.

Cylindrical resilient retainer 80 presents a structure that is along the lines of the retainer shown and described in U.S. Pat. No. 3,752,515 to Oaks et al. and U.S. Pat. No. 4,316,636 to Taylor et al. Retainer 80 has a body 82 with a plurality of protrusions 84 that extend in a radial outward direction. The cutting tool 60 carries the resilient retainer 80 in the reduced diameter section 72 thereof. As illustrated in FIG. 4, when the cutting tool 60 is retained within the bore 40 of the core breaker support 30, the protrusions 84 of the resilient retainer 80 are received within the annular groove 52 so that the cutting tool 60 is retained within bore 40 in such a fashion that it is free to rotate about its longitudinal axis (B—B, see FIG. 4) relative to the core breaker support 30.

Still referring to FIG. 4, cutting tool 60 has an overall axial length equal to dimension "C". The length of the portion of cutting tool 60 that extends axial forward of the core breaker support 30 is dimension "D". The rearward shank 70 has a diameter equal to dimension "E". The maximum diameter of the bit body is dimension "F". The hard carbide tip 68 has a generally conical portion that has an included angle "G". Table 1 below sets out dimensions C through F and angle G. The thickness (see dimension "H" in FIG. 4) of the cylindrical portion (or collar) 75 is about 0.012 inches (30.5 millimeters).

TABLE 1

Dimensions C through F and Angle G

| Dimension | Magnitude |
|---|---|
| C | 3.58 inches (91 millimeters) |
| D | 1.89 inches (48 millimeters) |
| E | 0.80 inches (20 millimeters) |
| F | 1.06 inches (27 millimeters) |
| G | 75 degrees |

The included angle "G" may range between about 50 degrees and about 80 degrees. In this regard, applicants contemplate that other models of cutting tools are suitable for use in the core breaker. In this regard, three other models of cutting tools sold by Kennametal Inc. are identified along with selected parameters in Table 2 below.

TABLE 2

Selected Parameters of Kennametal U50KH 75, U50KL and U51KL 68 Cutting Tools

| | Cutting Tool | | |
|---|---|---|---|
| Parameter | U50KH 75 | U50KL | U51KL 68 |
| Overall Axial Length (millimeters) | 84 mm/ 3.31 inches | 86 mm/ 3.40 inches | 91 mm/ 3.58 inches |
| Length Tool Extends Past the Core Breaker When Installed (millimeters) | 41 mm/ 1.61 inches | 43 mm/ 1.70 inches | 48 mm/ 1.89 inches |
| Diameter of the Rearward Shank (millimeters) | 20 mm/ .80 inches | 20 mm/ .80 inches | 20 mm/ .80 inches |
| Maximum Diameter of the Cutting Tool Body (millimeters) | 27 mm/ 1.06 inches | 27 mm/ 1.06 inches | 27 mm/ 1.06 inches |
| Included Angle of the Hard Carbide Tip (degrees) | 75 | 50 | 68 |

TABLE 2-continued

Selected Parameters of Kennametal U50KH 75, U50KL and U51KL 68 Cutting Tools

| Parameter | Cutting Tool U50KH 75 | U50KL | U51KL 68 |
|---|---|---|---|
| the ratio of the diameter of the shank to the overall axial length of the cutting tool | .24 | .235 | .22 |
| the ratio of the maximum diameter of the tool body to the overall axial length of the cutting tool | .32 | .31 | .30 |

In the specific embodiment of FIG. 4, the ratio of the diameter "E" of the shank to the overall axial length "C" of the cutting tool 60 is about 0.21. The ratio of the diameter "E" of the shank to the overall axial length "C" of the cutting tool 60 can range between about 0.15 and about 0.25. In the specific embodiment of FIG. 4, the ratio of the maximum diameter "F" of the tool body to the overall axial length "C" of the cutting tool is about 0.56. The ratio of the maximum diameter "F" of the tool body to the overall axial length "C" of the cutting tool can range between about 0.50 to about 0.60.

As is shown by the dimensions set forth in Table 2, for the U50KH 75 Kennametal the ratio of the diameter of the rearward shank to the overall axial length of the cutting tool is about 0.24 and can range between about 0.2 and about 0.3. For the U50KH 75 Kennametal tool, the ratio of the maximum diameter of the tool body to the overall axial length of the cutting tool is about 0.32 and can range between about 0.25 and about 0.35. As is shown by the dimensions set forth in Table 2, for the U50KL Kennametal the ratio of the diameter of the rearward shank to the overall axial length of the cutting tool is about 0.235 and can range between about 0.2 and about 0.3. For the U50KL Kennametal tool, the ratio of the maximum diameter of the tool body to the overall axial length of the cutting tool is about 0.31 and can range between about 0.25 and about 0.35. As is shown by the dimensions set forth in Table 2, for the U51KL 68 Kennametal the ratio of the diameter of the rearward shank to the overall axial length of the cutting tool is about 0.22 and can range between about 0.2 and about 0.3. For the U51KL 68 Kennametal tool, the ratio of the maximum diameter of the tool body to the overall axial length of the cutting tool is about 0.30 and can range between about 0.25 and about 0.35.

When in an operable condition, the cutting tool 60 is rotatably retained within the bore 40 as described above and as shown in FIG. 4. The geometry of the hard carbide tip 68 is such so as to be relatively sharp, and as a result provide good penetration of the cutting tool 60 into the earth strata. By the cutting tool 60 being able to achieve good penetration into the earth strata, not as much energy or power is necessary to drive the core breaker through the earth strata as compared to a tool that did not have good penetration. Furthermore, by providing a core breaker that uses a cutting tool with good penetration, there is less resistance to the passage of the cutting tool through the earth strata, and hence, the forces exerted top the cutting tool 60 are not as great as in the case of a cutting tool that did not have good penetration. The rotation of the cutting tool 60 about its central longitudinal axis (B—B) helps keep the hard carbide tip 68 sharp, as well as more evenly distributes the tension and compression forces exerted on the cutting tool about the circumference of the cutting tool as the cutting tool flexes during operation.

During the operation of the continuous mining machine, the cutting tool 60 will over time become worn to such a degree so that it must be replaced or it may possibly fail due to breakage. One point of failure can be at the braze joint between the hard carbide tip and the tool body. Further, in view of the fact that the portions of the tool body 61 surrounding the puller groove 74 present the largest diameters, the cutting tool 60 would typically break at a point axial forward of the puller groove. Along the lines of what is disclosed and shown in U.S. Pat. No. 4,542,943 to Montgomery, Jr. (U.S. Pat. No. 4,542,943 to Montgomery, Jr. is hereby incorporated by reference herein), it is also possible to design the shank of the tool to fail (or break) at a particular location that is axial forward of the puller groove. Thus, the puller groove 74 is typically accessible whether the tools wear out or the tool breaks. In this regard, the replacement of the cutting tool 60 is relatively easy since the operator places an elongate puller bar in the puller groove 74 and pries (or pulls) the cutting tool 60 out of the bore 40. The operator can then take a new (or useful) cutting tool 60 and insert the same in the bore 40 typically using a soft mallet to drive the cutting tool 60 into the bore 40.

During the operation of the continuous mining machine 10 the core breaker support 24 also provide structural support for the rotatable cutting tools 60. In this regard, the cylindrical portion 75 of the cutting tool 60 is contained within the bore 40 so as to be surrounded by and closely adjacent to the cylindrical wall 47 of bore 40. The wall of the bore 40 surrounds the entire rearward shank of the cutting tool 60 so as to restrain the rearward shank of the cutting tool 60 from flexing.

Furthermore, the rearward facing frusto-conical shoulder 78 of the cutting 60 is in contact with the forward frusto-conical wall 48 of the bore 40. Because the geometry of the rearward facing frusto-conical shoulder 78 of the cutting 60 is essentially the same as the geometry of the forward frusto-conical wall 48 of the bore 40, the frusto-conical wall 48 of the bore 40 provides structural support for the cutting bit 60 through the contact with the frusto-conical shoulder 78 of the cutting bit 60 so that the cutting tool 60 is not driven further into the bore 40 of the core breaker support 24.

Figure 5:
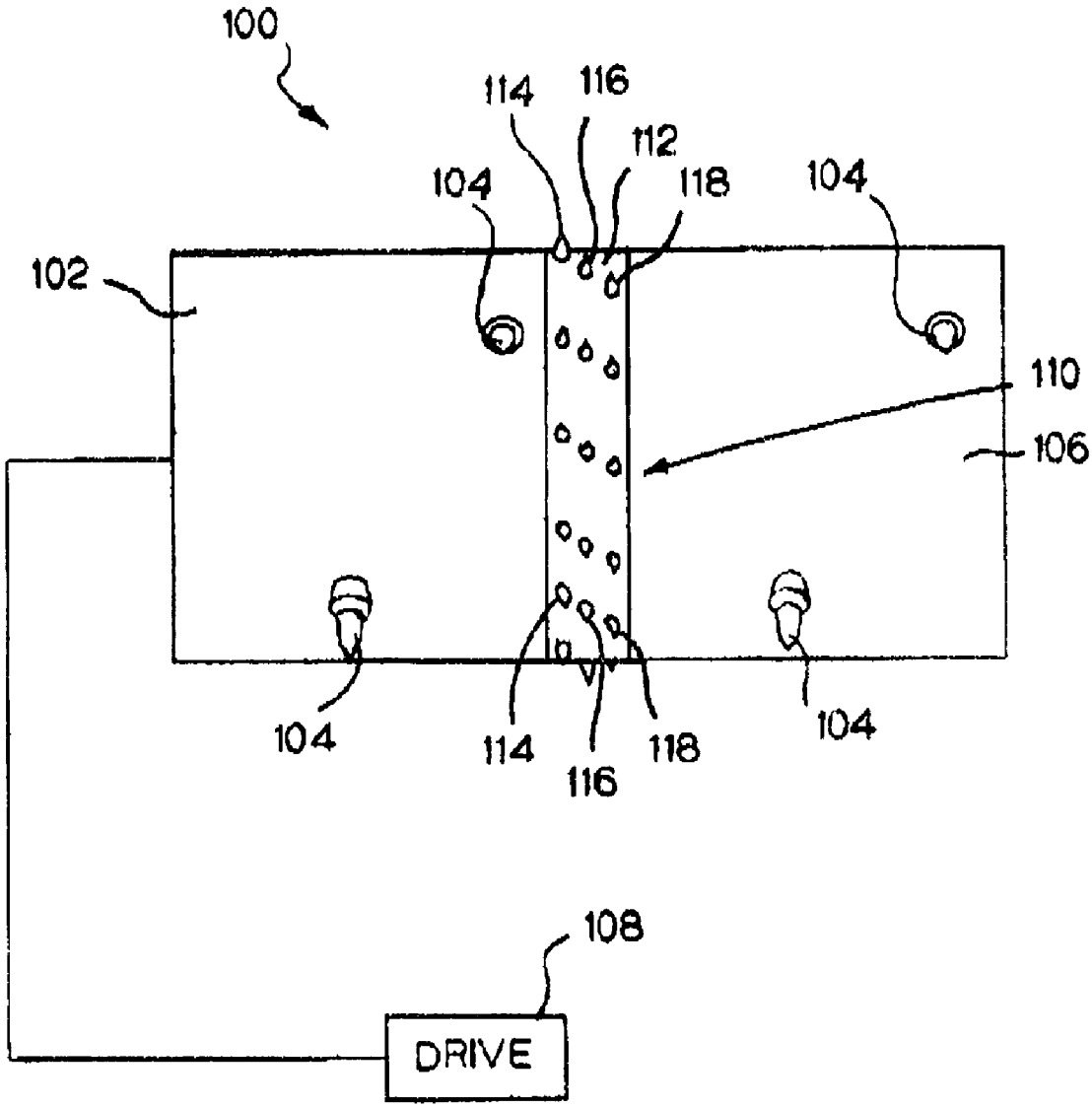
FIG. 5 is a mechanical schematic view of a second embodiment of a continuous mining machine that includes two cutting drums and a core breaker that has multiple rows of rotatable cutting tools.
Figure 6:
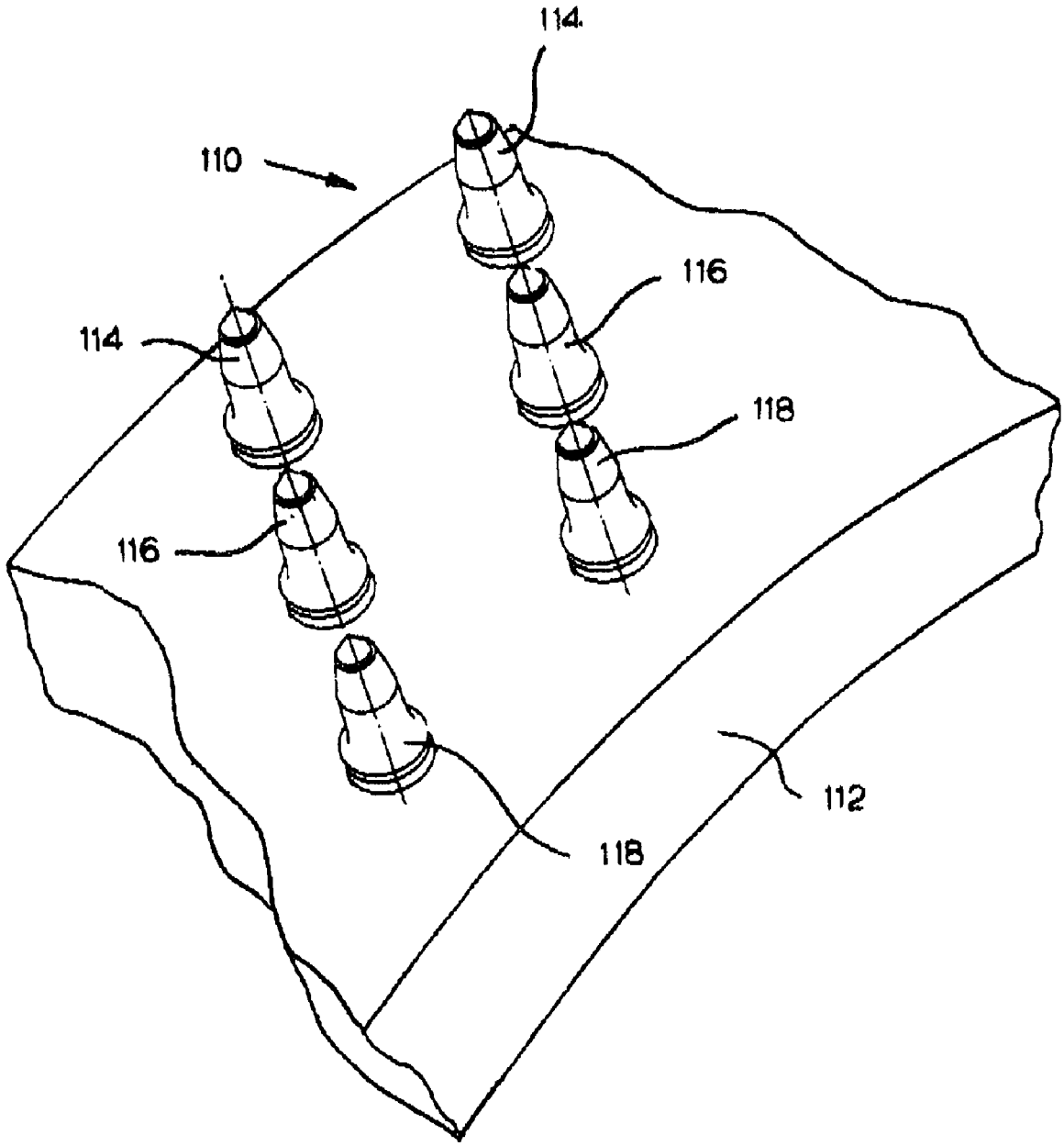
FIG. 6 is an isometric view of a portion of the core breaker of FIG. 5.

Referring to FIGS. 5 and 6, there is shown a second specific embodiment of a continuous mining machine (i.e., an earth strata cutting assembly) generally designated as 100. Continuous mining machine 100 includes a first rotatable cutting drum 102 that presents a plurality of cutting tools (or bits) 104 arranged in a helical pattern about the surface of the drum 102. Continuous mining machine 100 further includes a second rotatable cutting drum 106 that also presents a plurality of cutting tools (or bits) 104 arranged in a helical pattern about the surface of the drum 106. The first cutting drum 102 is spaced apart from (and yet can be considered to be adjacent to) the second cutting drum 106. The cutting drums (102, 106) are operatively connected to a motor 108 that drives the rotatable cutting drums (102, 106). A core breaker 110 is positioned so as to be between the first and second cutting drums (102, 106).

The core breaker 110 has a core breaker support 112. There are three rows of cutting tools positioned about the surface of the core breaker support 112 wherein each one of these cutting tools are structurally identical to the cutting tool 60. One row of the cutting tools comprises cutting tools 114. A second row of the cutting tools comprises cutting tools 116. A third row of cutting tools comprises cutting tools 118. As can be appreciated, the cutting tools (114, 116, 118) can be oriented on the core breaker support 112 in a number of different ways depending upon the particular application.

It can thus be seen that the above structure provides an improved core breaker for use in an earth strata cutting assembly (e.g., a continuous mining machine) wherein the core breaker uses a cutting tool that has a hard carbide tip brazed to the cutting tool at the axial forward end thereof.

It is also apparent that the above structure provides an improved core breaker for use in an earth strata cutting assembly (e.g., a continuous mining machine) wherein the core breaker uses a cutting tool that has a relatively sharp hard carbide tip at the axial forward end thereof so as to not increase the energy necessary to drive the core breaker through the earth strata, as well as to not increase the resistance to the passage of the cutting tool through the earth strata which increases the forces exerted on the cutting tool.

It is also apparent that the above structure provides an improved core breaker for use in an earth strata cutting assembly (e.g., a continuous mining machine) wherein the core breaker uses a cutting tool that is relatively easy to extract even after failure, as well as being relatively easy to extract after the tool has become worn to a point where it does not cut in a satisfactory manner.

It is also apparent that the above structure provides an improved core breaker for use in an earth strata cutting assembly (e.g., a continuous mining machine) wherein the core breaker uses a cutting tool that is rotatable about its central longitudinal axis so that tension and compressive forces are distributed about the circumference of the cutting tool body improving the fatigue life of the cutting tool and preventing the concentration of forces (either tension forces or compressive forces) at one side.

It is also apparent that the above structure provides an improved core breaker for use in an earth strata cutting assembly (e.g., a continuous mining machine) wherein the core breaker provides structural support for the rearward portion of the cutting tool during the operation of the continuous mining machine.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A core breaker for use with a continuous mining machine used to cut earth strata and wherein the continuous mining machine has at least two spaced-apart cutting drums whereby each one of the cutting drums cuts the earth strata leaving a core, the core breaker comprising:

a support positioned mediate of the two cutting drums, and the support containing at least one bore, the bore being defined in part by an axial forward frusto-conical wall, and the bore being further defined by an axial rearward cylindrical wall;

the axial rearward cylindrical wall containing a groove therein;

an elongate cutting tool adapted to impinge upon the earth strata of the core, and the elongate cutting tool having an axial forward end and an axial rearward end, the cutting tool having a head adjacent to the axial forward end and a shank adjacent to the axial rearward end, and a frusto-conical shoulder mediate of the head and the shank;

the shank containing a reduced diameter portion;

the cutting tool further including a resilient retainer; and when the cutting tool is retained within the bore, the resilient retainer is received within the groove in the bore and the frusto-conical shoulder of the cutting tool is closely adjacent to the frusto-conical wall of the bore.

2. The core breaker of claim 1 wherein the support contains a plurality of the bores therein.

3. The core breaker of claim 2 further including a plurality of the cutting tools wherein each cutting tool is rotatably contained within its corresponding one of the bores.

4. The core breaker of claim 1 wherein the support contains a plurality of rows of the bores therein, and further including a plurality of the cutting tools wherein each cutting tool is rotatably contained within its corresponding one of the bores.

5. The core breaker of claim 1 wherein the cutting tool is rotatable, and the cutting tool being replaceably retained within the bore.

6. The core breaker of claim 1 wherein the cutting tool having a hard tip at the axial forward end thereof.

7. The core breaker of claim 6 wherein the hard tip is relatively sharp and has an included angle ranging between about 50 degrees and about 80 degrees.

8. The core breaker of claim 1 wherein during the operation of the core breaker the frusto-conical shoulder of the cutting tool being a contact with the forward frusto-conical wall of the bore.

9. The core breaker of claim 1 wherein the cutting tool contains a puller groove axial forward of the frusto-conical shoulder.

10. The core breaker of claim 1 wherein a bore wall defines the bore, when the cutting tool is retained within the bore, the shank is in close proximity to the bore wall.

11. The core breaker of claim 1 wherein the ratio of the diameter shank to the overall axial length of the cutting tool is between about 0.2 and about 0.3.

12. The core breaker of claim 1 wherein the ratio of the maximum diameter of the tool body to the overall axial length of the cutting tool is between about 0.25 and about 0.35.

13. The core breaker of claim 5 wherein the bore of the core breaker support being defined at least in part by an axial forward cylindrical wall, and the elongate rotatable cutting tool further including a cylindrical collar being axial forward of the frusto-conical shoulder, and when the cutting tool is retained within the bore the cylindrical collar is closely adjacent to the axial forward cylindrical wall of the bore.

14. The core breaker of claim 13 wherein during the operation of the core breaker the cylindrical collar is in contact with the axial forward cylindrical wall of the bore.

15. A core breaker support for use in conjunction with a continuous mining machine used to cut earth strata wherein the continuous mining machine has at least two spaced-apart cutting drums wherein each one of the cutting drums cuts the earth strata leaving a core, the core breaker comprising:

a support positioned mediate of the two cutting drums, and the support containing at least one bore wherein the bore is adapted to receive an elongate cutting tool adapted to impinge upon the earth strata of the core wherein the elongate cutting tool has an axial forward end and an axial rearward end and a head adjacent to the axial forward end and a shank adjacent to the axial rearward end with a frusto-conical shoulder mediate of the head and the shank wherein the shank contains a reduced diameter portion and the cutting tool further has a resilient retainer, and the bore being defined in part by an axial forward frusto-conical wall, and the bore being further defined by an axial rearward cylindrical wall, and the axial rearward cylindrical wall containing a groove therein; and when the elongate cutting tool is retained within the bore, the resilient retainer is received within the groove in the bore and the frusto-conical shoulder of the elongate cutting tool is closely adjacent to the frusto-conical wall of the bore.

16. The core breaker support of claim 15 including a plurality of the bores.

17. The core breaker support of claim 15 including a plurality of rows of the bores.

18. An earth strata cutting assembly comprising:

at least a pair of spaced-apart adjacent cutting drums wherein each one of the cutting drums cuts a volume of the earth strata so as to leave a core and a core breaker positioned mediate of the cutting drums;

the core breaker comprising a support positioned mediate of the cutting drums, and the support containing at least one bore, the bore being defined in part by an axial forward frusto-conical wall, and the bore being further defined by an axial rearward cylindrical wall wherein the axial rearward cylindrical wall containing a groove therein;

an elongate cutting tool adapted to impinge upon the earth strata of the core, and the elongate cutting tool having an axial forward end and an axial rearward end, the cutting tool having a head adjacent to the axial forward end and a shank adjacent to the axial rearward end, and a frusto-conical shoulder mediate of the head and the shank, and the shank containing a reduced diameter portion;

the cutting tool further including a resilient retainer; and when the cutting tool is retained within the bore, the resilient retainer is received within the groove in the bore and the frusto-conical shoulder of the cutting tool is closely adjacent to the frusto-conical wall of the bore.

19. The earth strata cutting assembly of claim 18 wherein the cutting tool is rotatable.

20. The earth strata cutting assembly of claim 18 wherein the core breaker support contains a plurality of the bores therein, and the core breaker support further including a plurality of the cutting tools wherein each one of the cutting tools is rotatably contained within its corresponding one of the bores.

21. The earth strata cutting assembly of claim 18 wherein the cutting tool having a hard tip at the axial forward end thereof.

22. The earth strata cutting assembly of claim 18 wherein during the operation of the earth strata cutting assembly, the frusto-conical shoulder of the cutting tool being a contact with the forward frusto-conical wall of the bore.

23. The earth strata cutting assembly claim 19 wherein the bore of the core breaker support being defined at least in part by an axial forward cylindrical wall, and the elongate rotatable cutting tool further including a cylindrical collar being axial forward of the frusto-conical shoulder, and when the cutting tool is retained within the bore the cylindrical collar is closely adjacent to the axial forward cylindrical wall of the bore.

24. The earth strata cutting assembly of claim 23 wherein during the operation of the core breaker the cylindrical collar is in contact with the axial forward cylindrical wall of the bore.

25. The earth strata assembly of claim 18 wherein the ratio of the diameter shank to the overall axial length of the cutting tool is between about 0.2 and about 0.3.

26. The earth strata assembly of claim 18 wherein the ratio of the maximum diameter of the tool body to the overall axial length of the cutting tool is between about 0.25 and about 0.35.

27. A core breaker for use with a continuous mining machine used to cut earth strata and wherein the continuous mining machine has at least two spaced-apart cutting drums whereby each one of the cutting drums cuts the earth strata leaving a core, the core breaker comprising:

a support positioned mediate of the two cutting drums, and the support containing a plurality of rows of bores, each one of the bores being defined in part by an axial forward frusto-conical wall, and each one of the bores being further defined by an axial rearward cylindrical wall;

the axial rearward cylindrical wall containing a groove therein;

an elongate rotatable cutting tool adapted to impinge upon the earth strata of the core, and the elongate cutting tool being contained within each one of the bores, and the rotatable cutting tool having an axial forward end and an axial rearward end, the rotatable cutting tool having a head adjacent to the axial forward end and a shank adjacent to the axial rearward end, and a frusto-conical shoulder mediate of the head and the shank;

the shank containing a reduced diameter portion;

the rotatable cutting tool further including a resilient retainer; and when the rotatable cutting tool is retained within the bore, the resilient retainer is received within the groove in the bore and the frusto-conical shoulder of the rotatable cutting tool is closely adjacent to the frusto-conical wall of the bore.

28. An earth strata cutting assembly comprising:

at least a pair of spaced-apart adjacent cutting drums wherein each one of the cutting drums cuts a volume of the earth strata so as to leave a core and a core breaker positioned mediate of the cutting drums;

a support positioned mediate of the two cutting drums, and the support containing a plurality of rows of bores, each one of the bores being defined in part by an axial forward frusto-conical wall, and each one of the bores being further defined by an axial rearward cylindrical wall;

the axial rearward cylindrical wall containing a groove therein;

an elongate rotatable cutting tool adapted to impinge upon the earth strata of the core, and the elongate cutting tool being contained within each one of the bores, and the rotatable cutting tool having an axial forward end and an axial rearward end, the rotatable cutting tool having a head adjacent to the axial forward end and a shank adjacent to the axial rearward end, and a frusto-conical shoulder mediate of the head and the shank;

the shank containing a reduced diameter portion;

the rotatable cutting tool further including a resilient retainer; and when the rotatable cutting tool is retained within the bore, the resilient retainer is received within the groove in the bore and the frusto-conical shoulder of the rotatable cutting tool is closely adjacent to the frusto-conical wall of the bore.

29. The earth strata assembly of claim 28 wherein the ratio of the diameter shank to the overall axial length of the cutting tool is between about 0.2 and about 0.3.

30. The earth strata assembly of claim 28 wherein the ratio of the maximum diameter of the tool body to the overall axial length of the cutting tool is between about 0.25 and about 0.35.

31. A core breaker for use with a continuous mining machine used to cut earth strata and wherein the continuous mining machine has at least two spaced-apart cutting drums whereby each one of the cutting drums cuts the earth strata leaving a core, the core breaker comprising:

a support positioned mediate of the two cutting drums, and the support containing at least one bore; and an elongate rotatable cutting tool adapted to impinge upon the earth strata of the core and being rotatably contained within the bore.

32. The core breaker of claim 31 wherein the cutting tool has a hard tip at an axial forward end thereof.

33. The core breaker of claim 32 wherein said hard tip is relatively sharp.

34. The core breaker of claim 33 wherein the hard tip has an included angle ranging between about 50 degrees and about 80 degrees.

35. An earth strata cutting assembly comprising:

at least a pair of spaced-apart adjacent cutting drums wherein each one of the cutting drums cuts a volume of the earth strata so as to leave a core and a core breaker positioned mediate of the cutting drums;

the core breaker positioned mediate of the two cutting drums, and the core breaker comprising a support containing at least one bore; and an elongate rotatably cutting tool adapted to impinge upon the earth strata and the elongate cutting tool being rotatably contained within the bore; and wherein the bore being defined in part by an axial forward frusto-conical wall, and the bore being further defined by an axial rearward cylindrical wall wherein the axial rearward cylindrical wall containing a groove therein; the cutting tool having an axial forward end and an axial rearward end, the cutting tool having a head adjacent to the axial forward end and a shank adjacent to the axial rearward end, and a frusto-conical shoulder mediate of the head and the shank, and the shank containing a reduced diameter portion; the cutting tool further including a resilient retainer having at least one radial outward protrusion; and when the cutting tool is retained within the bore, the protrusions of the resilient retainer are received within the groove in the bore and the frusto-conical shoulder of the cutting tool is closely adjacent to the frusto-conical wall of the bore.

* * * * *